US007112078B2

(12) United States Patent
Czikora

(10) Patent No.: US 7,112,078 B2
(45) Date of Patent: Sep. 26, 2006

(54) GIMBLING ELECTRONIC CONNECTOR

(75) Inventor: Paul A. Czikora, Hockessin, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 11/069,859

(22) Filed: Feb. 28, 2005

(65) Prior Publication Data

US 2006/0194465 A1 Aug. 31, 2006

(51) Int. Cl.
*H01R 13/64* (2006.01)

(52) U.S. Cl. ..... 439/248; 439/63

(58) Field of Classification Search ..... 439/248, 439/63, 249, 246

See application file for complete search history.

(56) References Cited

U.S. PATENT DOCUMENTS 4,336,974 A * 6/1982 Wilson ..... 439/13
4,599,483 A * 7/1986 Kuhn et al. ..... 174/36
4,789,351 A 12/1988 Fisher, Jr. et al. ..... 439/248
4,925,403 A 5/1990 Zorzy ..... 439/578
5,217,391 A 6/1993 Fisher, Jr. ..... 439/578
5,329,262 A * 7/1994 Fisher, Jr. ..... 333/33
5,769,652 A 6/1998 Wider ..... 439/428
6,468,100 B1 * 10/2002 Meyer et al. ..... 439/320
6,699,054 B1 * 3/2004 Critelli ..... 439/248
2004/0038586 A1 2/2004 Hall et al. ..... 439/578

FOREIGN PATENT DOCUMENTS

WO WO 2004/019452 A1 3/2004

* cited by examiner

*Primary Examiner*—Hae Moon Hyeon
(74) *Attorney, Agent, or Firm*—Allan M. Wheatcraft

(57) ABSTRACT

A connector comprising first and second mating portions in electrical communication, each of the first and second mating portions having inner and outer conductors, wherein the first and second mating portions are independently radially displaceable while maintaining the electrical communication.

17 Claims, 4 Drawing Sheets

GIMBLING ELECTRONIC CONNECTOR

FIELD OF THE INVENTION

The present invention is directed to a connector, and more particularly, to a gimbling connector used to connect cables or electronic devices to one another.

BACKGROUND OF THE INVENTION

Connectors are devices that are frequently used to connect cables or electronic devices to one another. The connectors, cables, and electronic devices are often quite small, or have very small component parts that need to be intermated. As a result, very tight tolerances are required in order to ensure that all of the parts intermate successfully. Any out-of-tolerance pins or other connection or mating pieces can cause damage to or break the component parts. Specifically, in the event that a connector and an electronic device that are to be intermated are not in proper alignment, the pin of the electronic device, for example, may contact an undesirable part of the connector and break the pin off or cause other damage to the connector or the electronic device. Accordingly, very tight tolerances are required to ensure intermatability.

In an effort to alleviate this situation and allow for greater tolerances, a gimbling connector has been developed. With reference to FIG. 1, a known gimbling connector 100 has been developed to connect to electronic devices 110, 120 (which may be any electronic device or a cable or the like). As illustrated in FIG. 1, known gimbling connector 100 is adapted to gimble along its axis around its center point, much like a see-saw. By allowing each end of connector 100 to gimble up and down slightly, greater tolerances can be used because there is some play in the mating area. That is, each end of connector 100 is adapted to move up or down slightly so that as electronic devices 110, 120 are brought together and mated via connector 100, a non-destructive mating can be achieved even if electronic devices 110, 120 are not perfectly aligned with the axis of connector 100.

The disadvantage of the known connectors such as gimbling connector 100 are that the movement of each end of connector 100 is dependent upon the other. That is, as illustrated in FIG. 1, as the right side of connector 100 is deflected up slightly to accommodate out-of-tolerance mating with electronic device 120, this movement affects the left side of connector 100 which correspondingly moves down as it mates with electronic device 110. This is a result of the see-saw action of the gimbling connector 100, whereby each end may move radially, but this movement is dependent upon and affects the movement of the other end of the connector 100. So although this type of device provides for some loosening of tolerances, an even more forgiving connector is desirable. This would enable even greater loosening of tolerances and thereby greatly enhance manufacturing efficiencies.

SUMMARY OF THE INVENTION

The present invention provides a connector comprising first and second mating portions in electrical communication, each of the first and second mating portions having inner and outer conductors, wherein the first and second mating portions are independently radially displaceable while maintaining the electrical communication. Preferably, the first and second mating portions are displaceable by about ±0.020 inches. The first and second mating portions may each be either a female connector or a male connector.

Preferably, the connector is operable up to about 40 gigahertz. Also preferably, the connector is an blindmate/pushon type Gore-100, SMP, SMPM etc. connector. Also preferably, the inner and outer conductors of the first and second mating portions are coaxial.

In a preferred embodiment, the connector comprises:

a. a first mating portion having a first outer conductor; and a first inner conductor.

b. a second mating portion having a second outer conductor; and a second inner conductor.

c. a central body having a first side and second side, and defining a cavity;

d. the first mating portion mated to the first side of the central body by a first retaining means for retaining the first outer conductor in electrical communication with the central body;

e. the second mating portion mated to the second side of the central body by a second retaining means for retaining the second outer conductor in electrical communication with the central body; and f. a center conductor disposed within the cavity for electrically coupling the first and second inner conductors;

g. wherein the first and second mating portions are independently radially displaceable while maintaining the electrical communication.

In alternative embodiments, at least one of the first and second retaining means comprises a beveled washer, at least one of the first and second outer conductors comprises a slotted conductor, at least one of the first and second mating portions further comprises an insulator, at least one of the first and second retaining means comprises a snap ring, at least one of the first and second retaining means comprises a spring, the center conductor comprises a pin, the center conductor comprises a spring, and at least one of the retaining means is electrically conductive.

DESCRIPTION OF THE DRAWINGS

The operation of the present invention should become apparent from the following description when considered in conjunction with the accompanying figures.

DETAILED DESCRIPTION OF THE INVENTION

Figure 1:
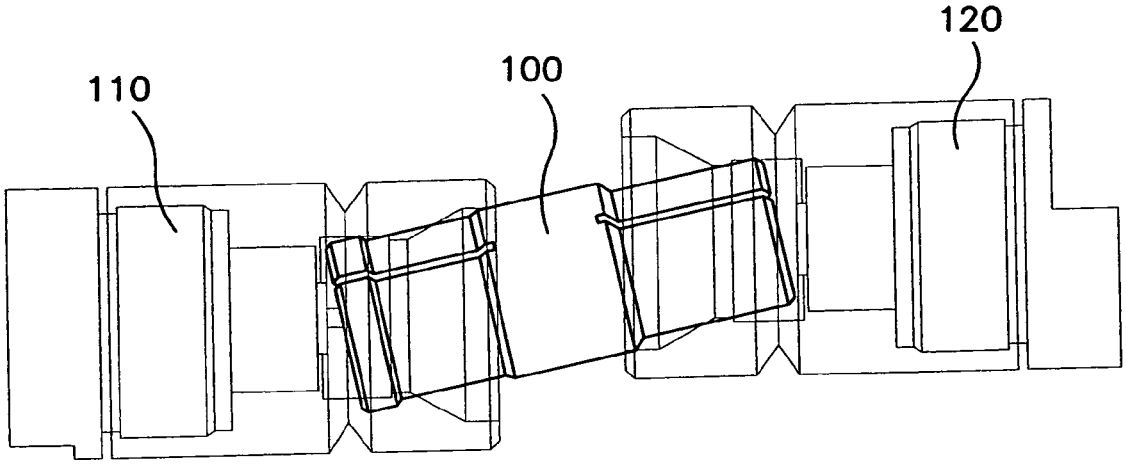
FIG. 1 (PRIOR ART)
FIG. 1 is a side view of a prior art connector.

The present invention provides a connector which has two independently radially displaceable mating portions at either end. Specifically, with reference to FIGS. 2 and 3, the present invention provides a connector 10 useful for attaching electronic devices 110, 120 to one another. Electronic devices 110, 120 may be any electronic device known in the art, or cable, or the like. Connector 10 comprises a first mating portion 11 and a second mating portion 14. First mating portion 11 and second mating portion 14 are in electrical communication with one another through central body 17.

Figure 2:
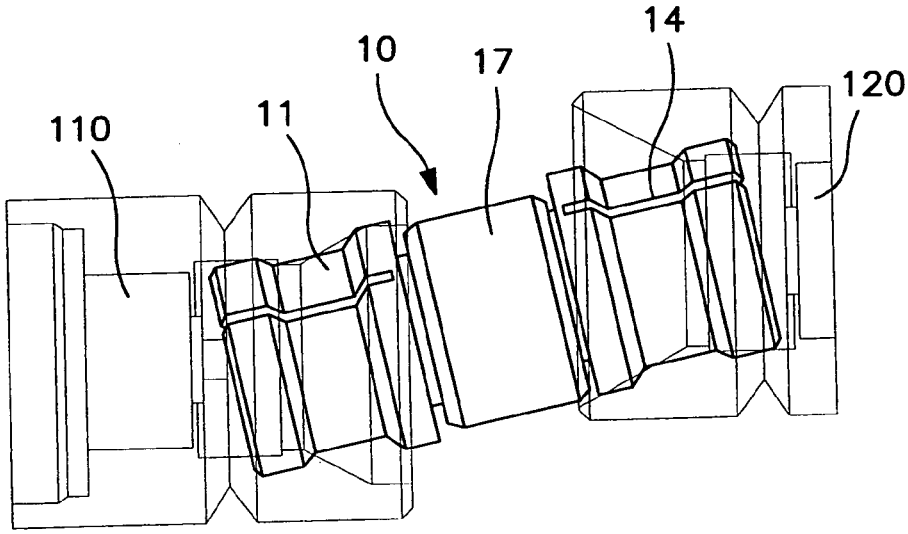
FIG. 2 is side view of a connector according to an exemplary embodiment of the present invention.
Figure 3:
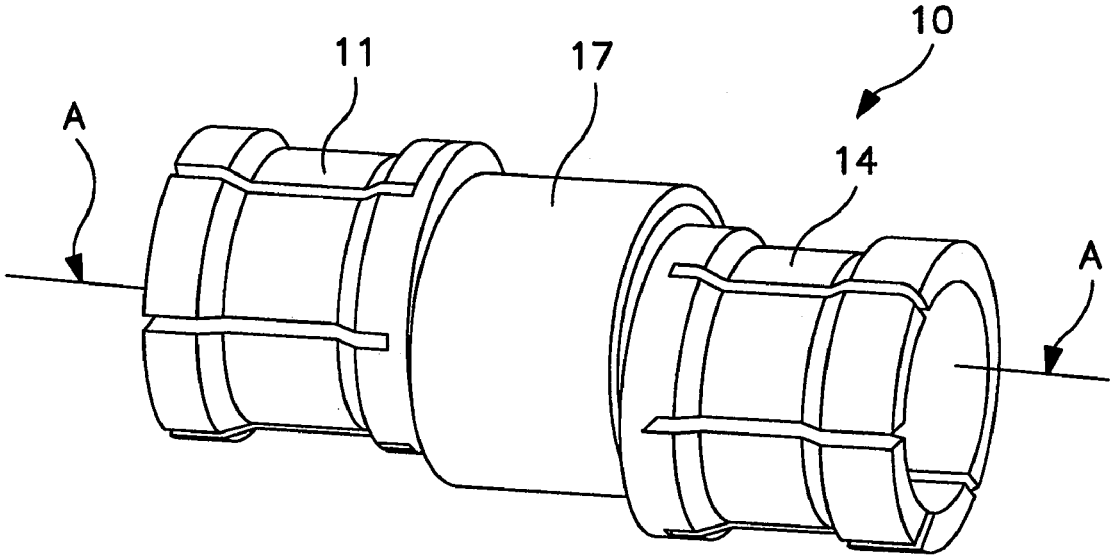
FIG. 3 is a perspective view of a connector according to an exemplary embodiment of the present invention.

Connector 10 has an axis, generally designated in FIG. 3 as "A". As illustrated in FIGS. 2 and 3, first mating portion 11 and second mating portion 14 are independently radially displaceable along axis A. That is, for the radius extending perpendicular to axis A, any movement along such radius (i.e., radial movement or displacement) of second mating portion 14 occurs without affecting the movement of first mating portion 11, which is free to move radially itself, without regard for any displacement of second mating portion 14.

Although first mating portion 11, and second mating portion 14 are adapted to be radially displaceable independent of one another, there is also some see-saw gimbling movement of connector 10 that occurs as well once either of first mating portion 11 or second mating portion 14 is displaced to the maximum extent in any direction. That is, upon such maximum displacement of first mating portion 11 or second mating portion 14, there can then be some see-saw type gimbling of the connector 10. It is the additional independent radial displacement of the two ends of connector 10 that provides the inventive feature, allowing additional alignment tolerances for electronic devices 110, 120 and for connector 10 itself.

Figure 4:
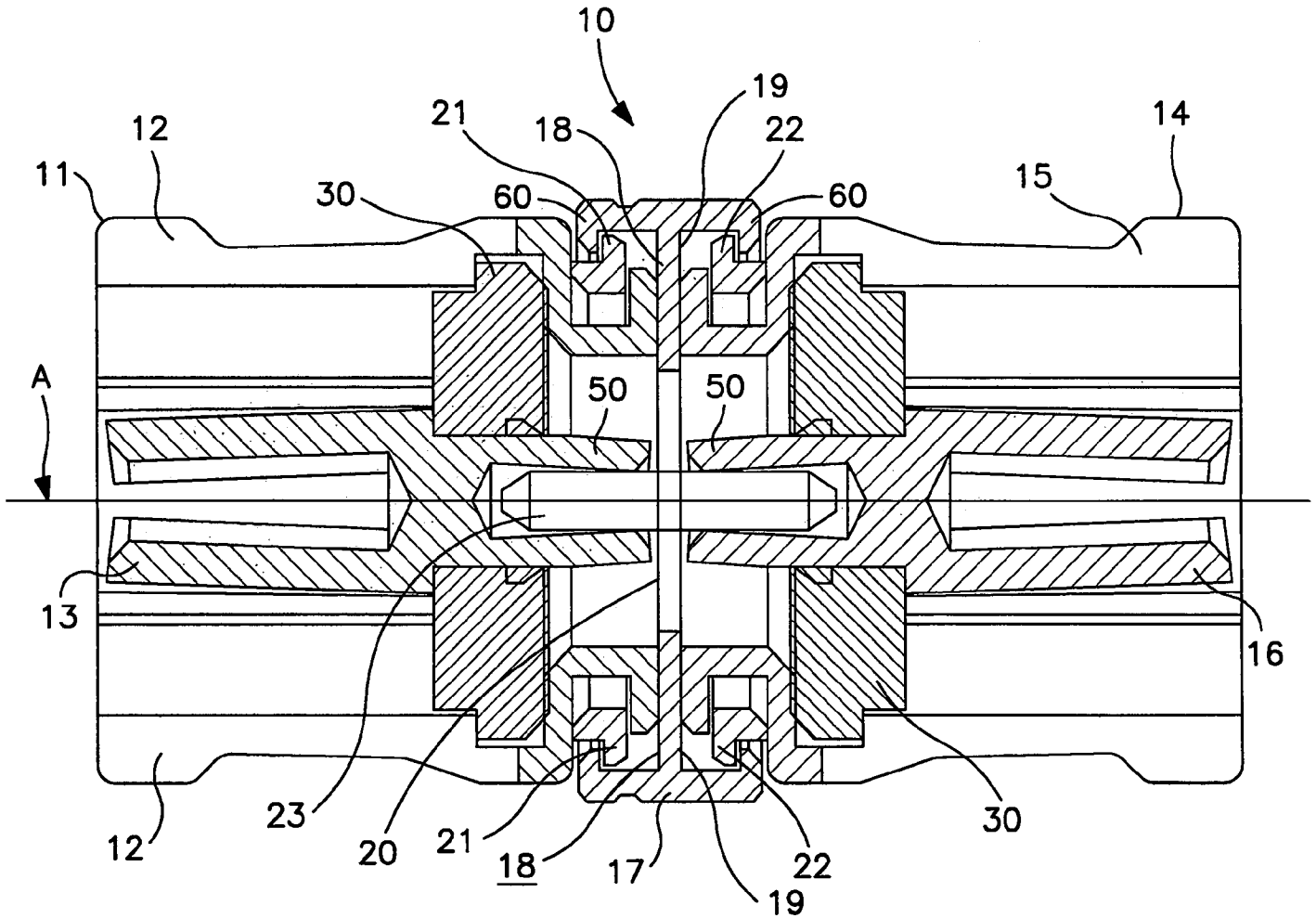
FIG. 4 is a side cross-sectional view of a connector according to an exemplary embodiment of the present invention.
Figure 5:
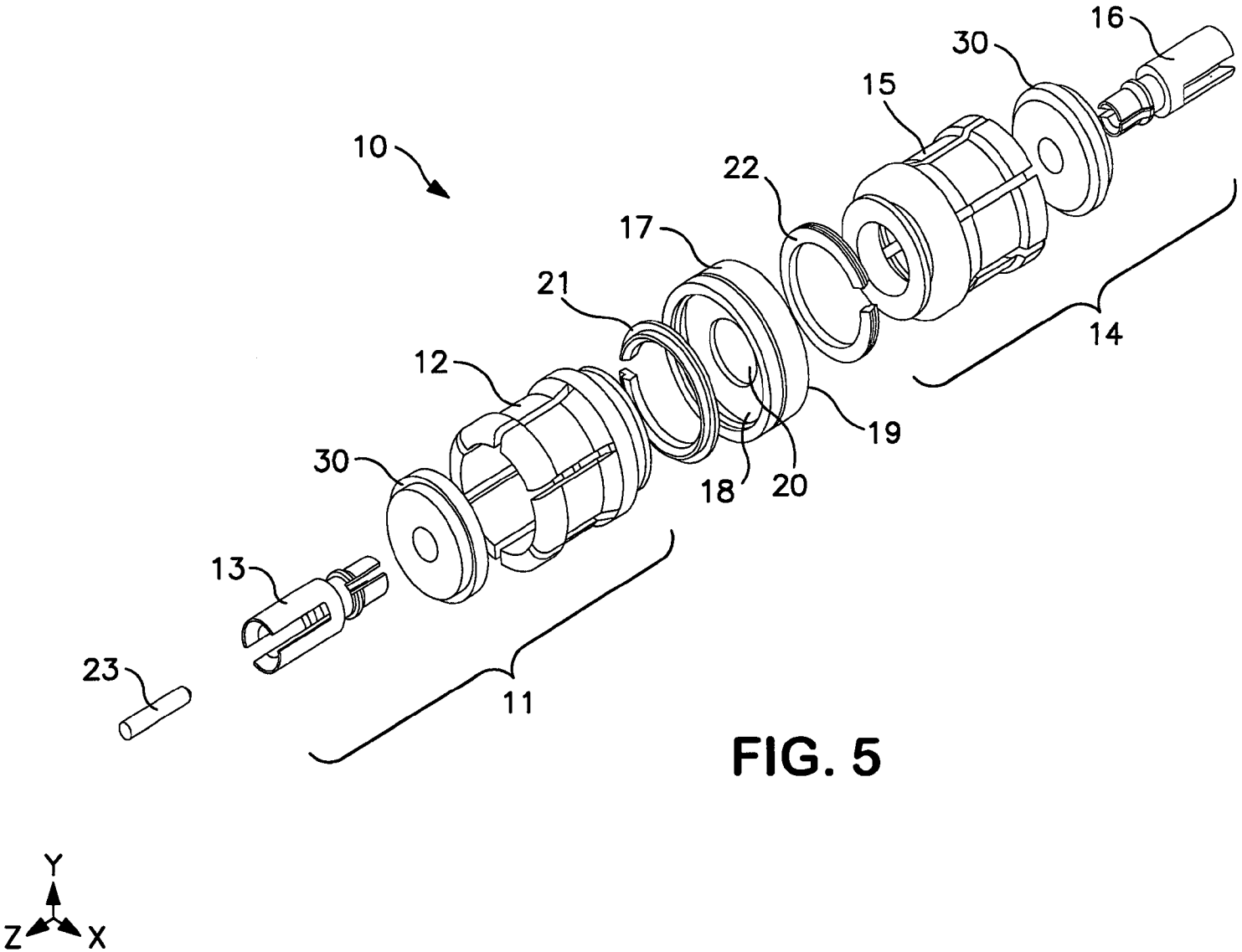
FIG. 5 is an exploded perspective view of a connector according to an exemplary embodiment of the present invention.

Specifically, with reference to FIGS. 4 and 5, the inventor now describes in more detail how the inventive connector is made and used. First outer conductor 12 has a first outer conductor 12 and a first inner conductor 13. First mating portion 11 contacts central body 17 at a first side 18 of central body 17. It is important to maintain contact of first outer conductor 12 with first side 18 of central body 17 at all times to ensure proper electrical communication within connector 10.

Central body 17 has a center conductor 23 disposed within a cavity 20 in the central body 17. First inner conductor 13 contacts center conductor 23 to ensure electrical communication therewith. Center conductor 23 is preferably a pin, a spring, or other device known in the art. Contact between center conductor 23 and first inner conductor 13 is achieved by means known in the art. Preferably, this electrical communication is achieved by using tapered fingers 50 as part of first inner conductor 13. Thus, as illustrated in the figures, first outer conductor 12 is in electrical communication with first side 18 of central body 17, and first inner conductor 13 is an electrical communication with center conductor 23.

On the opposite side of central body 17 from first mating portion 11 is second mating portion 14. Second mating portion 14 includes a second outer conductor 15 and a second inner conductor 16. Second outer conductor 15 mates with a second side 19 of central body 17. Electrical communication between second outer conductor 15 and central body 17 is thus achieved. This communication is essential.

Second mating portion 14 also has second inner conductor 16 in electrical communication with center conductor 23. This communication may be achieved in the same manner or, optionally, in a different manner as it is achieved between first inner conductor 13 and center conductor 23. Preferably, all of the parts on either side of central body 17 mirror one another.

Thus, with the inventive connector 10, an electrical path is maintained from first outer conductor 12 through central body 17 to second outer conductor 14. An electrical path is maintained and also from first inner conductor 13 through center conductor 23 to second inner conductor 16. In this manner, as first mating portion 11 is mated with an electronic device 110 and second mating portion 14 is mated with a second electronic device 120, electrical communication between electronic devices 110 and 120 is ensured.

First mating portion 11 is retained within central body 17 by a first retaining means 21. First retaining means 21 can be a snap ring, a spring, or a beveled washer. Similarly, second mating portion 14 is retained within central body 17 using second retaining means 22, which can have the same construction as first retaining means 21. Other retaining means may be used as will be recognized by those skilled in the art. In the exemplary embodiments shown, a lip 60 on either end of central body 17 may be used to interface with retaining means 21, 22.

Each of first mating portion 11 and second mating portion 14 are adapted to be independently radially displaceable. That is, with reference to first mating portion 11, the portion of first outer conductor 12 that contacts first side 18 of central body 17 is adapted to move up and down (i.e., radially), limited only by its maximum extension when it abuts either retaining means 21 or the edge of central body 17 itself. Similarly, with respect to second mating portion 14 is also free to move axially, limited only by its ultimate contact with second retaining means 22 or the edge of central body 17.

As first mating portion 11 and second mating portion 14 move radially independent of one another, center conductor 23 gimbles in see-saw fashion to accommodate the movement. Thus, although only first mating portion 11 may be axially displaced, center conductor 23 moves in conjunction with it which may slightly affect the position of second inner conductor 16 in the illustrated exemplary embodiment, but it will not significantly affect the radial movement of second mating portion 14 overall.

First mating portion 11 and second mating portion 14 may each be either a male or female connector. Preferably first retaining means 21 and second retaining means 22 are electrically conductive.

Preferably, an insulator 30 is disposed around first inner conductor 13 and second inner conductor 16. Insulator 30 may be any material known in the art, but polytetrafluoroethylene is preferred.

Using the present invention, the inventors have discovered that adequate electrical communication is achieved while allowing loosening of tolerances for the mating components of electronic devices and the inventive connector itself. As much as 0.020 inches of play on either side of axis A of inventive connector 10 is possible using the present invention. Thus, first and second mating portion 11, 14 are each displaceable by about ±0.020 inches. The present connector is operable at high frequency, such as 40, 65 or 110 gigahertz. Preferably, the inventive connector is a push-on or blindmating connector. Also preferably, the inner and outer conductors of the first and second mating portions 11, 14 are coaxial. In addition, the inventive concept is broad enough to be applied to any interface requiring intermating mating parts.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A connector comprising:

a. a first mating portion having a first outer conductor; and a first inner conductor;

b. a second mating portion having a second outer conductor; and a second inner conductor;

c. a central body having a first side and second side, and defining a cavity;

d. said first mating portion mated to said first side of said central body by a first retaining means for retaining said first outer conductor in electrical communication with said central body;

e. said second mating portion mated to said second side of said central body by a second retaining means for retaining said second outer conductor in electrical communication with said central body; and f. center conductor disposed within said cavity for electrically coupling said first and second inner conductors;

g. wherein said first and second mating portions are independently radially displaceable with respect to each other and to said central body while maintaining said electrical communication.

2. The connector as defined in claim 1 wherein said first and second mating portions are displaceable by about ±0.020 inches.

3. The connector as defined in claim 1 wherein said first mating portion is a female connector.

4. The connector as defined in claim 1 wherein said first mating portion is a male connector.

5. The connector as defined in claim 1 wherein said second mating portion is a female connector.

6. The connector as defined in claim 1 wherein said second mating portion is a male connector.

7. The connector as defined in claim 1 wherein at least one of said first and second retaining means comprises a beveled washer.

8. The connector as defined in claim 1 wherein at least one of said first and second outer conductors comprises a slotted conductor.

9. The connector as defined in claim 1 wherein at least one of said first and second mating portions further comprises an insulators.

10. The connector as defined in claim 1 wherein said connector is operable at about 40 gigahertz.

11. The connector as defined in claim 1 wherein said connector is an SMPM connector.

12. The connector as defined in claim 1 wherein said inner and outer conductors of said first and second mating portions are coaxial.

13. The connector as defined in claim 1 wherein at least one of said first and second retaining means comprises a snap ring.

14. The connector as defined in claim 1 wherein at least one of said first and second retaining means comprises a spring.

15. The connector as defined in claim 1 wherein said center conductor comprises a pin.

16. The connector as defined in claim 1 wherein said center conductor comprises a spring.

17. The connector as defined in claim 1 wherein at least one of said retaining means is electrically conductive.

* * * * *

UNITED STATES PATENT AND TRADEMARK OFFICE

CERTIFICATE OF CORRECTION

PATENT NO. : 7,112,078 B2
APPLICATION NO. : 11/069859
DATED : September 26, 2006
INVENTOR(S) : Paul Czikora It is certified that error appears in the above-identified patent and that said Letters Patent is hereby corrected as shown below:

At column 6, line 10, “insulators” should be --insulator--.

Signed and Sealed this

Nineteenth Day of December, 2006

JON W. DUDAS
*Director of the United States Patent and Trademark Office*